United States Patent [19]

Magazzu'

[11] Patent Number: 4,955,312

[45] Date of Patent: Sep. 11, 1990

[54] CONTROLLED GEOMETRY HYDROFOIL BOAT

[75] Inventor: Alfredo Magazzu', Palermo, Italy

[73] Assignee: Rodriquez S.p.A., Messina, Italy

[21] Appl. No.: 279,284

[22] Filed: Nov. 30, 1988

Related U.S. Application Data

[63] Continuation of Ser. No. 26,957, Mar. 17, 1987, abandoned.

[30] Foreign Application Priority Data

Apr. 4, 1986 [IT] Italy ..... 12456 A/86

[51] Int. Cl.[5] ..... B63B 1/22

[52] U.S. Cl. ..... 114/280

[58] Field of Search ..... 114/271, 272, 273–282

[56] References Cited

U.S. PATENT DOCUMENTS

| | | | |
|---|---|---|---|
| 3,139,059 | 6/1964 | Haford | 114/273 |
| 3,146,457 | 8/1964 | Von Schertel | 114/277 |
| 3,168,067 | 2/1965 | Graig | 114/279 |
| 3,183,871 | 5/1965 | Reder | 114/281 |
| 3,267,897 | 8/1966 | Picker | 114/279 |
| 3,343,513 | 9/1967 | Bader | 114/282 |
| 3,357,389 | 12/1967 | Wray, Jr. | 114/282 |
| 3,613,622 | 10/1971 | Bueller | 114/282 |
| 4,080,922 | 3/1978 | Brubaker | 114/282 |

FOREIGN PATENT DOCUMENTS

| | | | |
|---|---|---|---|
| 1546885 | 11/1968 | France | 114/282 |
| 765117 | 9/1980 | U.S.S.R. | 114/280 |

*Primary Examiner*—Joseph F. Peters, Jr.
*Assistant Examiner*—Jesûs D. Sotelo
*Attorney, Agent, or Firm*—Emmanuel J. Lobato; Robert E. Burns

[57] ABSTRACT

The invention refers to a variable geometry hydrofoil boat, equipped for this purpose with secant foils supported by articulated arms operated automatically or manually. The invention makes it possible to obtain a craft which, depending on operational requirements, may function either in the "totally submerged foil" mode or in the "secant foil" mode, that is to say with a variable foil surface. The secant foils supported by arms articulated to the hull may, in a variant of the embodiment, also be applied to fast-moving and streamlined naval units of the semi-planing type, for the purpose of damping their rolling and pitching movements.

2 Claims, 3 Drawing Sheets

CONTROLLED GEOMETRY HYDROFOIL BOAT

This is a continuation of application Ser. No. 07/26,957, filed Mar. 17, 1987, now abandoned.

BACKGROUND OF THE INVENTION

It is well-known that conventional hydrofoil boats with totally immersed foils have the drawback, quite similar to that of aircraft, that it is not possible to reduce the flying speed below the minimum lifting speed. In practice, in the case of said hydrofoil boats, this penalizes considerably the operational possibilities of the craft, which is forced in fact to chose between unacceptably high speeds and navigating in displacement conditions.

The use of hyperlifting systems, commonly used for aircraft, has not found practical employment as far as concerns these craft, for many reasons, among which the fact that even using the hydrofoils in a concordant manner (as normal curving foils), the result obtained would be to lose part of the run against efficient and safe control of transverse stability.

BRIEF SUMMARY OF THE INVENTION

The aim of this invention is to overcome these disadvantages by means of a variable geometry hydrofoil boat, equipped with secant foils supported by arms articulated to the hull or controlled by hand and/or automatic means.

With the hydrofoil boat according to the invention, the following basic operating conditions are thus possible:

(a) When the hydrofoil boat is navigating at high speed, supported by the lift solely of the totally submerged foils, the secant foils, raised above the surface of the water, are in any case ready to intervene in the event of failure of the automatic transverse stabilizing system.

(b) When the hydrofoil boat has to take off, the secant foils, in a lowered position, supply extra lift in addition to that of the totally submerged foils, allowing take-off speeds and thus power peaks considerably lower than those required by a traditional hydrofoil boat with totally submerged foils.

(c) Partial or complete lowering of the secant foils, by means of their articulated supporting arms, allows (due to the greater foil surface) speeds considerably lower than in the case of totally submerged foils, and consequently the craft has a greater operational range.

(d) The articulated arms make it possible to house the secant foils under the hull, when coming alongside or berthing, so that the space requirements of a hydrofoil boat according to the invention are no different from those of a hydrofoil with totally submerged foils.

DESCRIPTION OF THE PREFERRED EMBODIMENT

Figure 1:
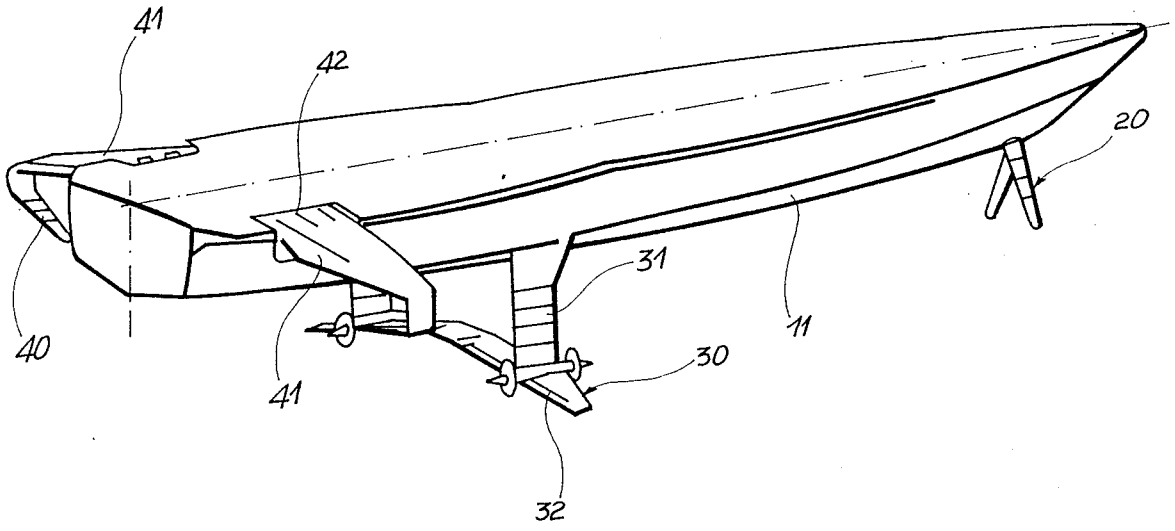
FIG. 1 is a schematic illustration, in perspective, of a typical application of the invention to a hydrofoil boat with totally submerged foils, of the "canard" type.

The following are visible in the above figures:

The overturned V secant bow foil 20, called upon to support a small fraction of the displacement.

The main foil, indicated as a whole by 30, totally submerged, and sustained by vertical struts 31, called upon to sustain the largest share of the displacement and fitted, typically, with ailerons 32 essential for operation of the hydrofoil boat in the totally submerged foil mode.

The secant foils 40, a fundamental aspect of this invention, joined solidly to the arms 41 are pivotally mounted on the hull of the boat 11 by means of the hinges 42.

Rotation of the arms may be achieved by means of the system represented schematically by hydraulic cylinders 43, or indeed by any means whatsoever.

It should be noted that transition from the structure of the supporting arms 41 to that of the secant foils 40, may also take place in an integrated form, that is to say without any actual break in continuity.

Figure 3:
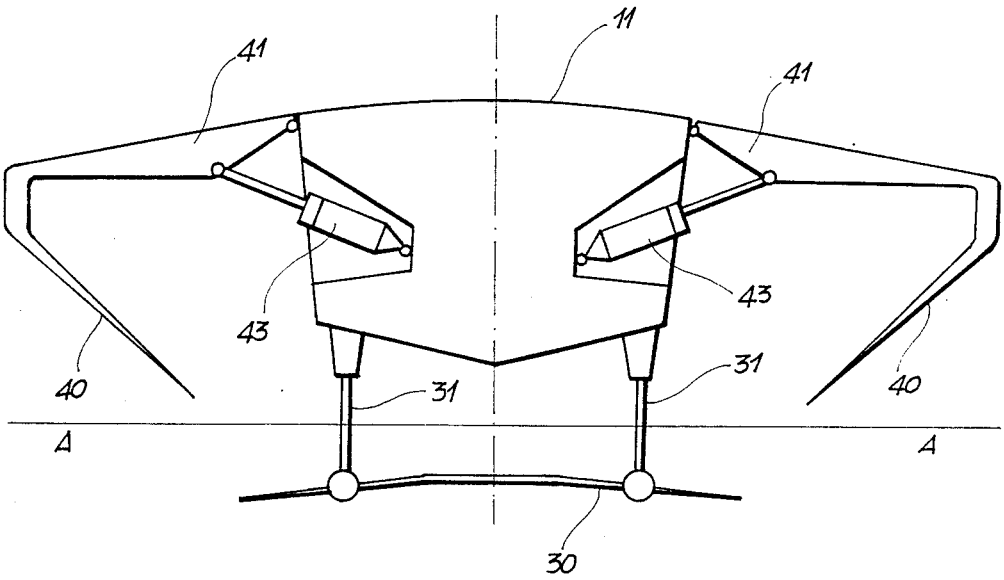
FIG. 3 is similar to FIG. 2, but shows the secant foils in a completely lifted position.

FIG. 3 shows the hydrofoil boat with the arms and foils 40 and 41 completely lifted, and navigating on the waterline A—A, in the submerged foil mode. It must be pointed out that this operating mode is essentially an automatic control system of a known type, which provides transverse stabilization of the unit only. The above since in the general configuration of the craft as suggested herein, stability of the longitudinal trim and of the flying height is conferred intrinsically by the bow secant foil. Any control of the heaving or pitching motion required for reasons of trim or increased comfort may easily be achieved by acting on the mobile surfaces of the main foil, also associated with lift variations of the bow foil.

Should a failure occur in this operating mode of any component of the transverse auto-stabilizing system, automatic or controlled lowering of the arms 41 would allow transition to the basically stable transversally "secant foil" mode.

Keeping the arms in such a way that the secant foils 40 remain only just above the surface of the water, the intervention of the secant foils would come about by effect of the sideways listing of the craft, even without any active manual or automatic intervention.

Another important advantage of this invention lies in the fact that by lowering the arms it is possible to increase the submerged foil surface by the amount required to reduce the speed of the craft to the desired level.

Adding to this the fact that, since lowering of the arms 41 and consequently transition to the "secant foil" mode determines spontaneous reconstitution of the basic transverse stability of the craft, the mobile surfaces 32 present on the submerged foil 30 may be employed to the required extent in a concordant manner as a further means of hyperlifting without the risk that it will not be possible to exercize the necessary and adequate control on lateral stability.

It is immediately remarked, at this point, that the above described considerable possibility of hyperlifting introduced by this invention constitutes a very important instrument for reducing considerably the take-off speed, which is necessarily high for total immersion foil craft of the conventional type, a drawback which constitutes a further and well-known disadvantage for these boats.

The hydrofoil boat according to this invention comes, therefore, as a real link between secant foil hydrofoil boats (of which it has the basic stability, the reliability, the low take-off speed, the wide range of operational speeds in flight) and totally submerged foil hydrofoil boats, of which it has (when operational requirements or weather conditions make this operational mode advisable) the lesser sensitivity to sea conditions, lower resistance to motion, greater efficiency of the main hydrofoil system, which operates in depth and therefore with less likelihood of ventilation and cavitation.

From the above, it is clear that all the advantages described up to now may be obtained substantially simply by equipping the arms 41 with a system of any type whatsoever, even manually operated, which allows positioning of same in the required configuration.

It is however possible to equip said arms with an automatic control system having characteristics capable of improving considerably the overall performance obtainable.

A more sophisticated control of the arms (nonetheless easily achievable, in that, for reasons explained below, high working frequencies are not required of them) makes it possible to perform coordinated turns even in the secant foil mode, as well as a more efficient control of lateral stability, in particular during the transition from one mode to another or in emergency situations.

According to the invention, coordinated turns may be performed in the "secant foil" mode by differential operation (that is to say with conjugate rotations) of the arms 41 so as to generate the necessary transversal listing of the craft yet maintaining its basic stability.

This manoeuvre, in addition to considerably improving the passengers' comfort, is also advisable in the "secant foil" mode, as it avoids flexural stresses on the struts of the main foil.

In the "submerged foil" mode, coordinated turning, indispensable in this case for well-known reasons, would obviously be achieved by the usual conjugated operation of the ailerons of the main foil, but the simultaneous conjugated movement of the arms would prevent submersion of the secant foil internal to the turn, although allowing said foils to be kept at a small distance from the water, ready, in case of excessive irregular skidding, to confer to the hydrofoil boat basic stability and this, as will be seen, even automatically.

With reference to lateral stability, for a better exploitation of the potential of the craft, as already mentioned, automatic control of the positions of the arms is certainly preferable.

Figure 2:
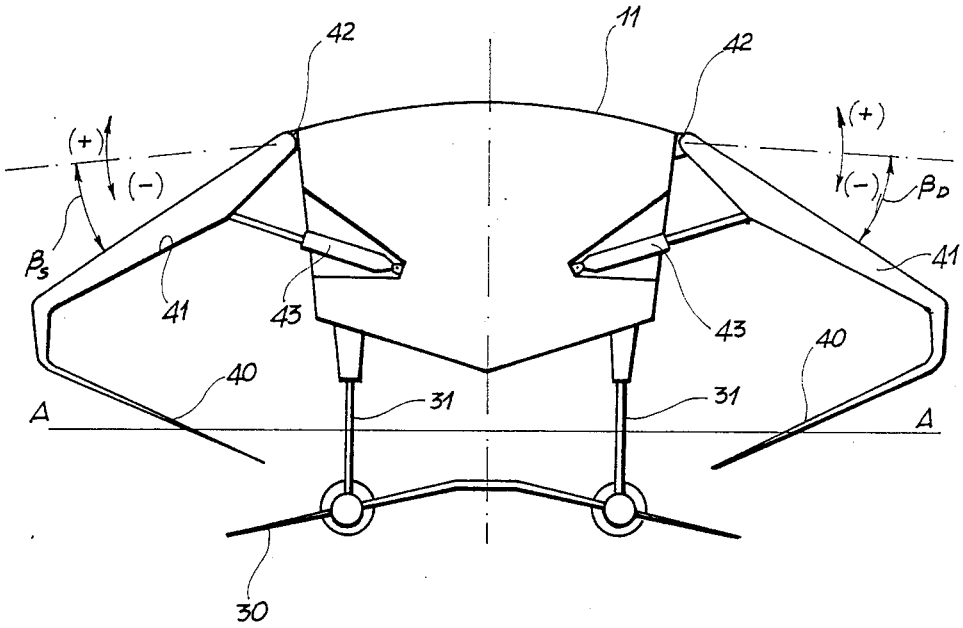
FIG. 2 is a transverse section of the same hydrofoil craft illustrated in FIG. 1, and shows both the totally submerged foil and the secant foil according to the invention, in its lowered position.

With reference also to the symbols of FIG. 2 (and letting p and p° be the instantaneous and running pressures in the upper chambers of the jacks 43 respectively) a possible law of control of the angles of the arms, given as an indication only, is expressed by the following equations:

$$B_s = -K_i\phi - K_p\phi' - K_d\phi'' - K_1(p - p^\circ) \quad (1)$$

$$B_d = -K_i\phi + K_p\phi' + K_d\phi'' - K_1(p - p^\circ)$$

where ($\phi$) indicates the rolling angle.

The resulting rolling control moment will therefore be:

$$M_c = K\,(B_s - B_d)$$

K being a parameter of obvious meaning, practically constant within a small range from a reference condition.

For the combination of the control laws 1 typical of a conventional naval antirolling system of the P.I.D. (Proportional Integral, Derivative) type and the special signal which uses the pressure in the upper jack chamber to measure the thrust of the secant foils, the following results are actually achieved:

It is obtained that the secant foils are submerged independently of the speed, until they receive a preestablished lift, easily adjustable by changing, for example, the value of the p° of (1).

This actually causes the tendency on the part of the foils to follow the outline of the wave form, if no other components of the control signal intervene (due, for example, to roll control requirements). In order to avoid making the arm control cylinders bear a high static load, it is of course possible, by designing appropriately the foil dihedrals, to arrange for the distance between the direction of the resultant of the hydrodynamic forces acting on the secant foils and the axis of rotation of the arms to be always maintained within preestablished limits.

(As a limit example, a continuous variation of the dihedral, in accordance with the arc of a circle having its centre on said axis of rotation, would allow complete cancellation of the moment of said resultant).

It is obtained, by sending these same control laws (with the exception of the terms proportional to (p—p°) also to the aileron control channel, that excitations having the highest frequency are actually "filtered" by the same arm control servo-system which, taking into account the dimensions, responds as a low pitch filter with a cut-off frequency lower than that of the aileron servos.

By doing this, without any special arrangements, it is possible to leave it to the ailerons 32 to compensate the highest frequency excitations, while only those having a lower frequency and therefore the most persistent, are compensated by the not particularly fast intervention of the arms 41.

With this control logic, it is easy to understand how transition from the "secant foil" mode (which, as mentioned above, is advisable during the take-off stage) to the "totally submerged foil" mode may take place in a wholly gradual manner, reducing bit by bit the reference signal p° present in (1), so as to discharge and let the secant foils emerge gradually, until they barely skim over the water, completely removed from the resistance to motion, therefore, but ready, however, to intervene automatically, as seen, in case of need.

Figure 4:
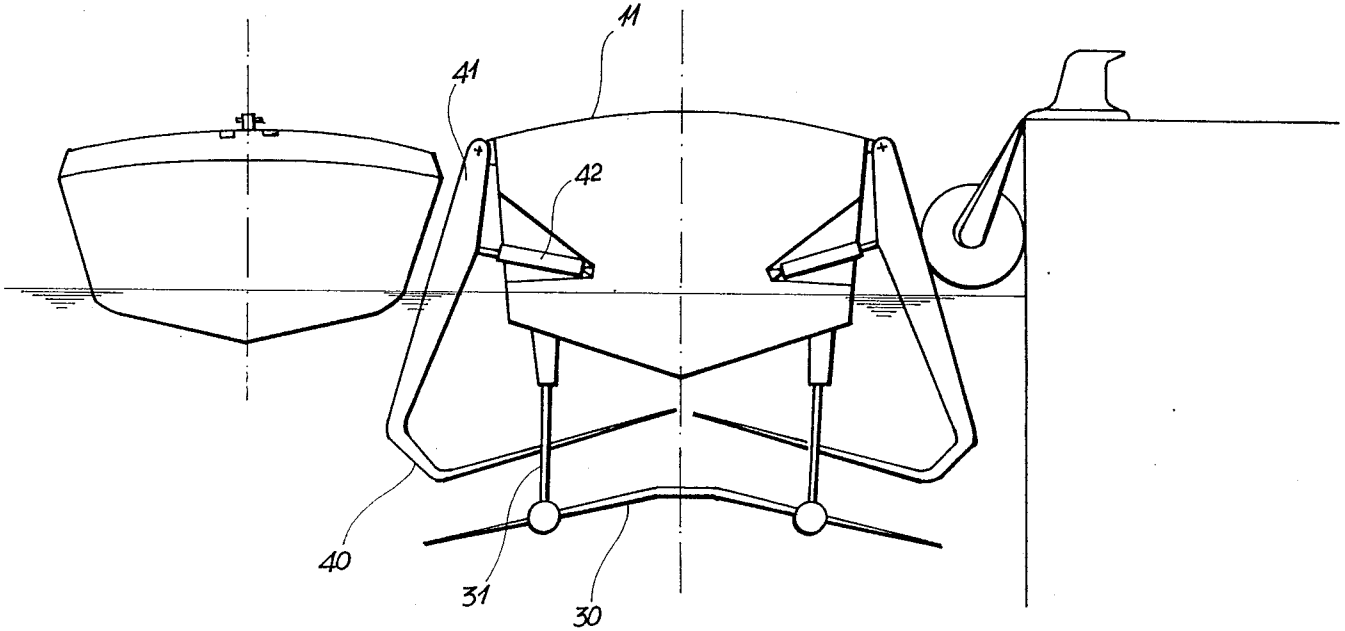
FIG. 4 shows yet another position of the secant foils according to the invention, to be used preferably while coming alongside and berthing.

The possibility of retracting the arms 41, as shown in FIG. 4, constitutes yet another advantage associated with the invention, as it makes for easier manoeuvering for berthing or coming alongside other craft, in restricted areas.

Another variant in the application of the invention is possible:

In associating the system of foils and articulated arms to a fast-moving hull (for example of the semi-planing type), or if desired, eliminating from the previously described hydrofoil boat the main hydrofoil system (submerged foils) and the bow foil system, a new type of sea-going unit is obtained, having the interesting characteristics described below.

The main advantages of the above type of innovative hull may be summarized as follows:

Possibility of exercizing an energetic damping of rolling and pitching, both in a basic form (and that is to say without recourse to automatic control of the positions of the arms) and, obviously to a greater extent, using for control of the arms laws of motion completely similar to those suggested for the first main embodiment described.

Conferral of basic stability to the hull (growing with speed) able to compensate the progressive loss of stability which occurs in general, as is well-known, as speed increases, in round-bottomed semi-planing fast-moving units.

Possibility of adjusting the submerged surfaces of the secant foils on the basis of the operational needs of the moment, thus eliminating any superfluous resistance.

Possibility of use as longitudinal and transverse trim correctors.

Possibility of exercizing, if the hydrofoil system is built in the flexible manner already suggested for the main embodiment, mechanical filtering of the highest frequency excitations due to the wave formation.

Possibility of easy inspection and maintenance (since all the parts of the foils and arms system may be lifted out of the water).

Possibility of retraction or lifting, in order to reduce as required, the dimensions and the draft, and for better manoevrability in restricted waters.

What I claim is:

1. In a variable geometry hydrofoil boat having a hull and hydrofoils for operating hullborne and foilborne, the improvement comprising, secant foils operable to a fully raised position outside of the hull and out of the water for operating hullborne or foilborne and to variable lowered positions in which the secant foils are foilborne, means comprising a pair of arms articulated on said hull for movement relative to corresponding opposite sides thereof for each pivotally mounting a corresponding secant foil on the hull and fixed relative to the corresponding arm, means for moving the arms angularly relative to the corresponding opposite sides of the hull for alternatively moving the corresponding secant foil to said fully raised position in which the secant foils are in a non-operative condition relative to lifting of the hull but ready to intervene, and to said variable lowered position in which the secant foils contribute dynamically to lifting the hull, said means for moving said arms comprising hydraulic jacks each connected to a corresponding arm for variably angularly moving the arm relative to the hull, and said jacks are connected to the pair of arms for independently angularly moving the arms for selective independent positioning of each secant foil in variably selected raised and lowered positions.

2. In a variable geometry hydrofoil boat having a hull and hydrofoils for operating hullborne and foilborne, the improvement comprising, secant foils operable to a fully raised position outside of the hull and out of the water for operating hullborne or foilborne and to variable lowered positions in which the secant foils are foilborne, means comprising a pair of arms articulated on said hull for movement relative to corresponding opposite sides thereof for each pivotally mounting a corresponding secant foil on the hull and fixed relative to the corresponding arm, means for moving the arms angularly relative to the corresponding opposite sides of the hull for alternatively moving the corresponding secant foil to said fully raised position in which the secant foils are in a non-operative condition relative to lifting of the hull but ready to intervene, and to said variable lowered positions in which the secant foils contribute dynamically to lifting the hull, and said secant foils having a configuration for stowing in a position underneath the hull under control of a corresponding arm to minimize the transverse dimension of the boat.

* * * * *